US006221549B1

(12) United States Patent
Emoto et al.

(10) Patent No.: US 6,221,549 B1
(45) Date of Patent: Apr. 24, 2001

(54) TONER FOR DEVELOPING LATENT ELECTROSTATIC IMAGES, BINDER RESIN FOR USE IN THE TONER, AND IMAGE FORMATION METHOD USING THE TONER

(75) Inventors: Shigeru Emoto; Masahide Yamashita; Kumi Hasegawa, all of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/412,719

(22) Filed: Oct. 5, 1999

(30) Foreign Application Priority Data

| | | |
|---|---|---|
| Oct. 6, 1998 | (JP) | 10-283965 |
| Nov. 25, 1998 | (JP) | 10-334063 |
| Sep. 10, 1999 | (JP) | 11-256901 |

(51) Int. Cl.[7] ..... G03G 9/097
(52) U.S. Cl. ..... 430/110; 430/120
(58) Field of Search ..... 430/109, 110, 430/111, 137, 120

(56) References Cited

U.S. PATENT DOCUMENTS

| | | | |
|---|---|---|---|
| 5,747,210 | 5/1998 | Emoto et al. | 430/109 |
| 5,753,400 | 5/1998 | Kuramoto et al. | 430/126 |
| 6,013,406 * | 1/2000 | Moriki et al. | 430/110 |
| 6,017,670 * | 1/2000 | Hashizume et al. | 430/109 |

FOREIGN PATENT DOCUMENTS 0618511 10/1994 (EP) .

OTHER PUBLICATIONS

Database WPI Sec. Ch Week 199820 (Derwent) Class A05, AN 1998–221324 (XP–002126163) abstract of JP 10 063035 (Mar. 1998).

* cited by examiner

*Primary Examiner*—John Goodrow
(74) *Attorney, Agent, or Firm*—Cooper & Dunham LLP

(57) ABSTRACT

A toner for developing a latent electrostatic image to a visible toner image, which is suitable for use in an image formation method in which a toner recycle system is adopted, is proposed. The toner is such a toner that a tetrahydro-furan-soluble component contained therein exhibits a sub-peak within a weight-average molecular weight range of 100,000 to 10,000,000 in a molecular weight distribution measured by gel permeation chromatography, and the toner has a water content of 5000 ppm or less when the toner has been allowed to stand at 30° C., 60%RH for 24 hours. An image formation method using this toner is also proposed.

16 Claims, 3 Drawing Sheets

TONER FOR DEVELOPING LATENT ELECTROSTATIC IMAGES, BINDER RESIN FOR USE IN THE TONER, AND IMAGE FORMATION METHOD USING THE TONER

BACKGROUND OF THE INVENTION

1. Field of the Invention

The present invention relates to a toner for use in an image formation method, using electrophotography, electrostatic recording, electrostatic printing or the like, in which a toner recycle system is adopted. The present invention also relates to a binder resin for use in the above toner and to an image formation method using the toner, in which a toner recycle system is adopted.

2. Discussion of Background

Generally, in electrophotography, a latent electrostatic image is formed on a latent electrostatic image bearing member provided with a photoconductive layer comprising a photoconductive material through the processes of electrostatic charging and exposure. The latent electrostatic image bearing member is also referred to as "photoconductor".

The latent electrostatic image is developed to a toner image with toner composed of colored particles. The developed toner image is then usually transferred to an image recording material such as a sheet of paper, and fixed thereto, whereby a copy image is formed.

Conventionally, varieties of image fixing methods for fixing the toner image to the image recording material have been known, and a heat roller image fixing method is particularly widely used, since the heat roller image fixing method is capable of attaining high heat transfer efficiency and performing high speed image fixing.

The toner for use in the heat roller image fixing method is basically required to have the following performances: (1) excellent low-temperature image fixing performance by which image fixing can be securely performed at low temperatures, and (2) excellent anti-hot-offset performance by which a fused toner is made it difficult to be transferred to the heat roller at the time of image fixing.

Further, in order to form a clear copy image, the toner is required to have excellent preservation stability in such a way that the toner can be maintained in the form of powder in a stable manner without aggregation, either while in use or while in store.

Furthermore, in order to form high quality images free of fogging a number of times in a stable manner, the toner is required to have properties of being difficult to be crushed even when mechanical shocks, pressure and the like are applied to the toner in a development unit.

Recently, in order to use the toner economically, attention is paid to an image formation method using a toner recycle system, in which a used toner is recovered in the course of a cleaning process for the photoconductor, returned to the development unit, and reused. However, when a conventional toner is used in the above-mentioned image formation method in which the toner recycle system is adopted, there occur problems such as the reduction in image density, the smearing of the background of copy paper, the fogging of images, and the deposition of the toner on a carrier, as the number of copies made is increased. These problems are caused by the toner being deformed or broken by shearing force applied thereto in the course of the recycling process, whereby the toner is finely divided to form finely-divided toner particles. When this takes place, the toner loses its proper chargeable performance, and the finely-divided toner particles reduces the carrier's charge-imparting performance.

As the toners for use in such a recycle system, there are known several toners in which a cross-linked polyester resin is used as a binder resin as disclosed in Japanese Laid-Open Patent Applications 59-14144, 58-14147, 60-176049, 60-176054, 62-127748 and 62-127749. These toner, however, are so vulnerable to mechanical force that when mechanical force is frequently applied to the toners within the development unit in the course of the recycling process, the toners are broken into finely-divided toner particles. The thus formed finely-divided toner particles contaminate the carrier particles to reduce the charge-imparting performance of the carrier, resultantly causing insufficient charging of the toner, and lowering the developing performance of a developer transporting member and other units which are adversely affected by the insufficiently charged toner.

Such recycle systems have been studied not only with respect to the toner therefor, but also with respect to an image formation method. Recycle systems have been in fact developed and various inventions and improvements have been made in an image formation apparatus to be used with a recycle system as well. For instance, in an electrostatic image formation process, an attempt has been made to sue a residual toner remaining on an image bearing member after toner images have been transferred therefrom to an image receiving member.

Conventionally such a residual toner is collected and filled in recovery bottles which are exclusively used for this purpose and is discarded or processed as an industrial waste. Discarding such an industrial waste will, of course, cause environmental pollution problems and constitute wasting of resources. In order to avoid the discarding of such a used toner, various toner recycle systems have been studied.

Japanese Laid-Open Patent Application 63-246780 discloses a system in which a toner transport passage is provided for transporting a recovered toner from the cleaning unit to the development unit, and the recovered toner is used as part of toner to be supplied to the development unit.

Japanese Laid-Open Patent Application 1-118774 discloses a system of recovering the residual toner after in the development unit, without any cleaning unit being provided.

Japanese Laid-Open Patent Application 6-51672 discloses a system in which a bias-voltage applicable rotary member for recovering toner is provided, and toner is electrostatically recovered when an area corresponding to a sheet-passing portion of an image bearing member passes, and toner is deposited on the image bearing member when an area corresponding to a non-sheet-passing portion of the image bearing member passes.

These systems, however, have their own shortcomings and are not satisfactory for use in practice. In the system disclosed in Japanese Laid-Open Patent Application 63-246780, the toner transport passage such as a pipe is required, and furthermore, toner transport means such as a screw or a belt is indispensable, so that the system itself tends to become oversized an include complicated mechanisms. In the system disclosed in Japanese Laid-Open Patent Application 1-118774, it is difficult to recover the residual toner in the development unit once the toner is deposited as the residual toner on an image bearing member, since the residual toner is apt to be firmly fixed to the image bearing member, so that the background of the image and the image itself tend to be frequently smeared with the toner. Further, this system cannot easily cope with abnormal operations such as paper jamming, and the recovering operation frequently has adverse effects on the processes after the image bearing member is smeared. The shortcomings of these systems are not limited to the above. In any event, the above conventional systems are not yet satisfactory.

SUMMARY OF THE INVENTION

It is therefore a first object of the present invention to provide a toner for developing a latent electrostatic image to a high quality toner image, which toner is neither deformed nor broken even when used in a toner recycle system, which toner exhibits substantially no changes in the state of the surface of the toner, without any reduction in durability and quality even when used in the form of a developer, which toner is capable of forming toner images without causing fogging, reduction in image density, the deposition thereof on the background of images, the scattering thereof within a copying machine to smear the copying machine, and changes in quality depending upon environmental conditions thereof, which toner is suitable for use in a heat roller image fixing system provided with a toner recycle system, which toner has excellent low-temperature image-fixing performance as well as excellent anti-hot-offset performance, and which toner has high productivity in a production line for producing pulverized toner.

A second object of the present invention is to provide a binder resin for use in the above-mentioned toner.

A third object of the present invention is to provide an image formation method using the above toner.

The first object of the present invention can be achieved by a toner for developing a latent electrostatic image to a visible toner image used in an image formation method in which a toner recycle system is adopted, wherein the toner is such a toner that a tetrahydrofuran-soluble component contained therein exhibits a sub-peak within a weight-average molecular weight range of 100,000 to 10,000,000 in a molecular weight distribution measured by gel permeation chromatography, and the toner has a water content of 5000 ppm or less when the toner has been allowed to stand at 30° C., 60%RH for 24 hours.

In the above toner of the present invention, it is preferable that the tetrahydrofuran-soluble component be such a component that exhibits a top peak in a weight-average molecular weight range of 5,000 to 10,000 in the above-mentioned molecular weight distribution, and 35% to 55% of the tetrahydrofuran-soluble component has a weight-average molecular weight of 10,000 or less, and the toner satisfies the conditions represented by formulae (1) and (2), as measured by a flow tester of capillary type:

$$2\times Tfb-Tend-Ts\leqq 15 \quad (1)$$

$$15\leqq Tend-Ts-2\times(T1/2-Tfb)\leqq 40 \quad (2)$$

wherein Ts represents a softening point of the toner, Tfb represents a flow beginning temperature of the toner, Tend represents a flow ending temperature of the toner, and T1/2 represents a fusing temperature of the toner in T1/2 method.

It is also preferable that the above toner further comprises a binder resin comprising a polyester resin.

It is also preferable that the above-mentioned toner by prepared by fusing and kneading:

a binder resin comprising a tetrahydrofuran-insoluble component in an amount of 5 to 40 wt. %, the tetrahydrofuran-insoluble component having a degree of swelling in tetrahydrofuran in a range of 2 to 20, a coloring agent, a charge control agent, and optionally other additive and a releasing agent.

It is also preferable that in the above toner, the binder resin comprise a polyester resin.

The second object of the present invention can be achieved by a binder resin comprising a tetrahydrofuran-insoluble component in an amount of 5 to 40 wt. %, which tetrahydrofuran-insoluble component has a degree of swelling in tetrahydrofuran in a range of 2 to 20.

The third object of the present invention can be achieved by an image formation method in which a toner recycle system is adopted, using the above-mentioned toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1(*b*) is a graph showing a molecular weight distribution of the binder resin in FIG. 1(*a*), measured by GPC after the THF-insoluble component thereof has been subjected to molecular chain scission.

DESCRIPTION OF THE PREFERRED EMBODIMENTS

Figure 1A:
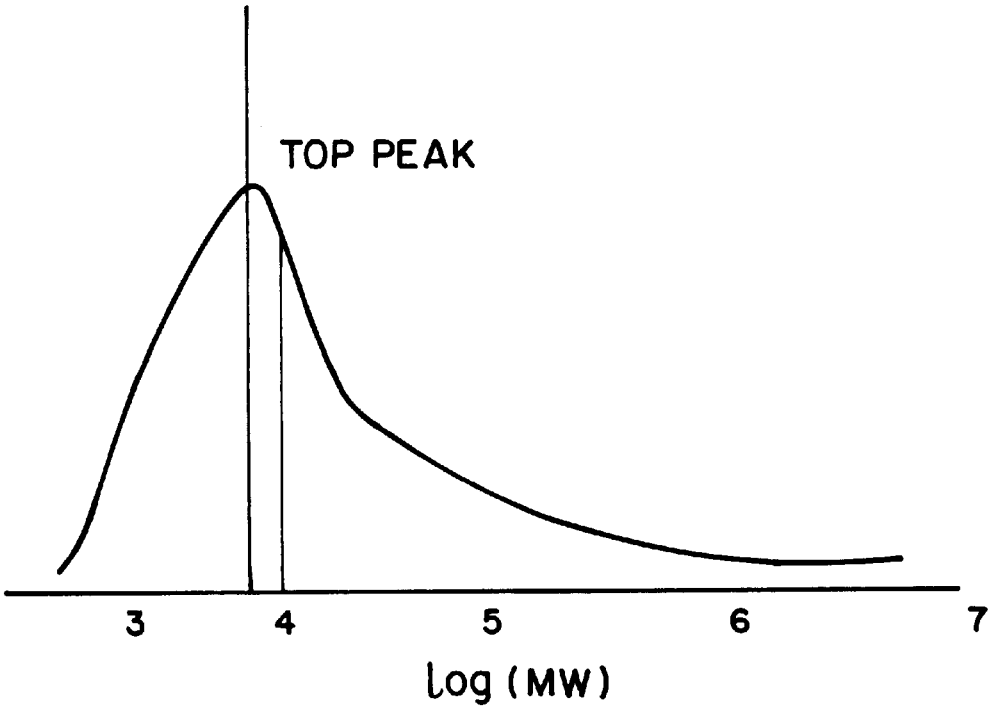
FIG. 1(*a*) is a graph showing a molecular weight distribution of a binder resin, measured by GPC before a THF-insoluble component contained in the binder resin is subjected to molecular chain scission.

In the electrophotographic copying machine provided with a toner recycle system, changes in the particle size of the toner produce various problems in terms of image quality. Such changes in the particle size are caused, for example, by the toner particles being finely pulverized while in use.

More specifically, the fine pulverization of the toner particles brings about changes in the charging performance of the toner, and the aggregation of the toner particles decreases the fluidity of the toner, with the result that uneven toner images are produced. When such toner particles are collected and used again by being mixed with a fresh toner, many problems occur, such as slow rise-up of the charging of the toner, and the deposition of the toner on the background of images at high temperature and high humidity.

The inventors of the present invention have prepared a toner which is capable of solving the above problems. The toner is capable of developing a latent electrostatic image to a visible toner image, for use in an image formation method in which a toner recycle system is adopted.

The toner according to the present invention will now be explained in detail.

A binder resin for use in the toner of the present invention comprises such a component that is insoluble in tetrahydrofuran (hereinafter referred to as a tetrahydrofuran-insoluble component or THF-insoluble component). The THF-insoluble component is subjected to molecular chain scission in the course of a kneading process for preparation of the toner by mechanical shearing energy applied to the binder resin due to the use of a kneader at the kneading process, so that the THF-insoluble component is converted into a THF-soluble component.

When the THF-insoluble is subjected to the molecular chain scission, there appears a sub-peak within a weight-average molecular weight range of 100,000 to 10,000,000 in a molecular-weight distribution measured by gel permeation chromatography (GPC). Such a sub-peak is never observed before the binder resin is kneaded. In other words, this peak does not appear in GPC before the mechanical shearing energy is applied to the binder resin. It can be observed that the THF-insoluble component which is present in the binder resin before the resin is kneaded is moved to a weight-average molecular weight range of 100,000 to 10,000,000 by the molecular chain scission of molecules in view of the molecular weight distribution chart thereof.

As will be explained in detail later, due to the molecular weight distribution with such a sub-peak as described above, the above-mentioned pulverization of the toner particles can be effectively prevented in the toner recycle system, whereby the changes in the charging performance of the toner and the reduction in the fluidity of the toner caused by the aggregation of the toner particles can be effectively controlled.

Furthermore, it is required that the toner of the present invention have a water content of 5,000 ppm or less when the toner has been allowed to stand at 30° C., 60%RH for 24 hours. By controlling the water content of the toner in the above-mentioned range, the charge quantity of the toner can be prevented from being changed, especially under high temperature and high humidity conditions. Thus, there can be obtained a toner with a minimum change in charge quantity substantially under any environmental conditions.

The above effects become conspicuous particularly in the image formation method in which a toner recycle system is adopted. This is because when a recycled toner is mixed with a fresh toner to form a mixed toner to reuse the recycled toner, the contents of additives of the mixed toner tend to differ from the contents of the additives of the fresh toner. Therefore, the toner for use in an image formation apparatus in which the toner recycle system is adopted is required to include a matrix material with significantly less variations in the charge quantity and charging rise-up performance under any environmental conditions than those of a matrix material for the toner for use in the image formation apparatus without using the toner recycle system.

From this point of view, it is required that the toner of the present invention have a water content of 5,000 ppm or less when the toner has been allowed to stand at 30° C., 60%RH for 24 hours.

It is more preferable that the toner of the present invention, which is suitable for use in the toner recycle system, be such a toner that contains the above-mentioned binder resin therein and that a THF-soluble component contained in the binder resin exhibit a top peak in a weight-average molecular weight range of 5,000 to 10,000 when measured by the gel permeation chromatography (GPC), and that 35 to 55% of the THF-soluble component have a weight-average molecular weight of 10,000 or less.

When the THF-soluble component is controlled to have the above-mentioned molecular weight range in the above-mentioned molecular weight distribution, proper productivity of the toner can be ensured, when the recyclability of the toner is taken into consideration. In addition, the tolerance of each of the low-temperature image fixing performance and the anti-hot-offset performance of the toner can be increased. Thus, there can be obtained a toner for use in the image formation method in which a toner recycle system is adopted, which toner is not substantially affected by any changes in ambient conditions thereunder.

A binder resin which contains therein such a THF-soluble component that exhibits a top peak, for instance, in a weight-average molecular weight of 5,000 when measured by the gel permeation chromatography (GPC) is simply referred to as a binder resin with a top peak of 5000.

It has been confirmed that when a binder resin with a top peak of less than 5,000 is used in the toner, the use of such a binder resin constitutes one of factors that increase the fine pulverization of the toner when the toner is stirred in the course of the transportation thereof or within a developer tank in a copying machine. On the other hand, when the above-mentioned top peak exceeds 10,000, the pulverization of the toner can be prevented, but the productivity of the toner is decreased and the dispersibility of the binder resin with other materials is lowered, so that when a binder resin with a top peak that exceeds 10,000 is used, it is difficult to attain the fundamental characteristics required for the toner.

Thus, it is preferable that the toner for use in the electrophotographic copying machine provided with the toner recycle system be such a toner that contains a binder resin therein, and that a THF-soluble component contained in the binder resin exhibit a top peak in a weight-average molecular weight range of 5,000 to 10,000 in the molecular weight distribution measured by the gel permeation chromatography (GPC), and that 35 to 55% of the THF-soluble component have a weight-average molecular weight of 10,000 or less as calculated based on a chart area in the molecular weight distribution measured by GPC, and that the THF-soluble component exhibit a sub-peak within a weight-average molecular weight range of 100,000 to 10,000,000 in the molecular weight distribution.

When the above toner is sued, various functions of the toner can be attained, with the pulverizing of the toner particles being controlled, so that a clear copy image can be obtained.

To be more specific, with respect to the binder resin, the top peak of 5,000 is considered to be one of criteria by which whether or not the intermolecular compatibility of the THF-soluble component in the binder resin is impaired, that is, whether or not the toner is pulverized by the stress applied thereto within the copying machine is judged.

The top peak in the weight-average molecular weight range of the binder resin is preferably in the range of 5,000 to 10,000, more preferably in the range of 5,000 to 8,000, for use in practice.

The information obtained from the above-mentioned molecular weight distribution of the binder resin is extremely important in order to secure the required functions of the toner.

The inventors of the present invention have discovered that there is an optimum range in a temperature curve obtained by a flow tester in order obtain the above-mentioned well-balanced toner.

The image fixing performance of the recyclable toner when a heat application roller is used has a close relationship with the melt viscoelasticity of the toner. In order to satisfy the requirement for the low-temperature image fixing performance, a binder resin with low thermal characteristics is suitable. As an index of the thermal characteristics, a melt index and other characteristics obtained by a flow tester or a rheometer are conventionally used. Further in order to satisfy the requirement for the anti-hot-offset performance which is inversely related to the requirement for the low-temperature image fixing performance, a binder resin with higher elasticity as compared with the conventional binder resin is sued for the recyclable toner, or a variety of waxes are employed as a releasing agent. The viscoelasticity measured by the rheometer is conventionally used as an index of the thermal characteristics of the binder resin.

However, the inventors of the present invention have discovered that there is an optimum range in a temperature curve obtained by a flow tester which serves as an index of the thermal characteristics of the toner which satisfies the requirement for both the low-temperature image fixing performance and the anti-hot-offset performance, with an extended image fixing temperature range. As the flow tester, for instance, a commercially available flow tester of capillary type (Trademark "CFT500", made by Shimadzu Corporation) can be employed, for instance, under the following measurement conditions:

Load: 10 kg/cm$^2$

Temperature elevation rate: 3.0° C./min

Diameter of die orifice: 0.50 mm

Length of die orifice: 10.0 mm

Figure 2:
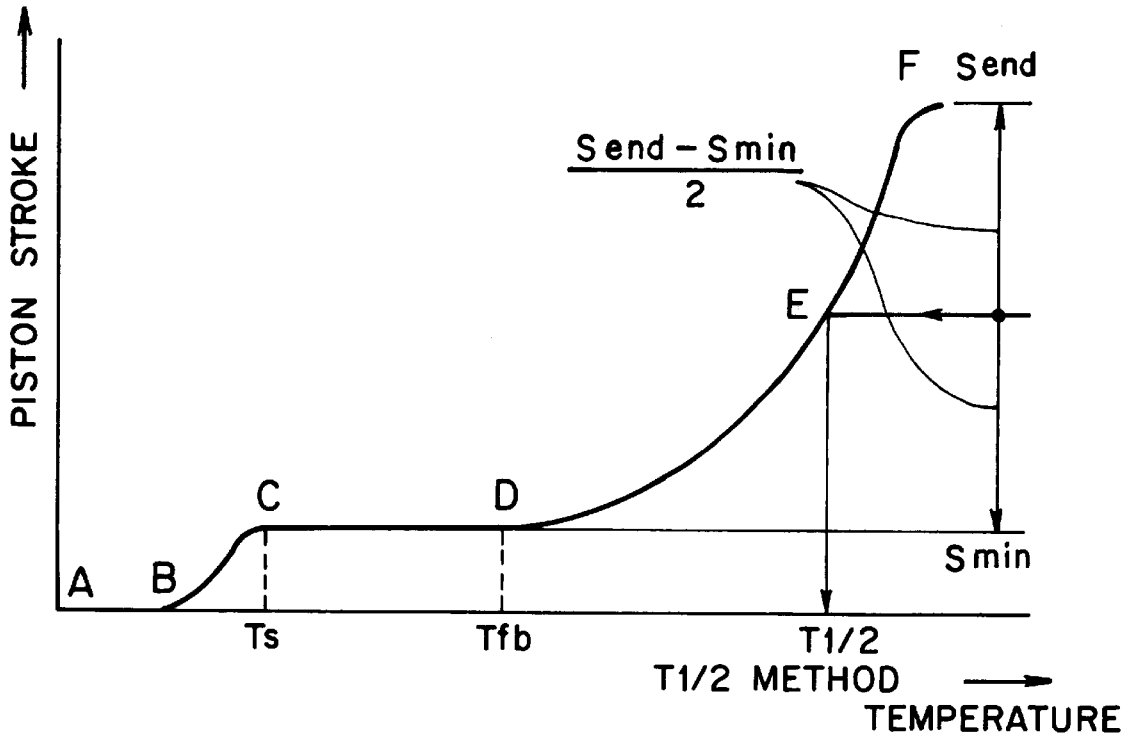
FIG. 2 is a diagram for calculating flow tester values of the toner of the present invention.

FIG. 2 is a diagram of a flow test based on the temperature curve obtained, using the flow tester.

In FIG. 2, Ts denotes a softening point of a toner sample; Tfb, a flow beginning temperature of the toner sample; and T1/2 denotes a fusing temperature of the toner sample in a T1/2 method.

Conventionally, each of the above-mentioned temperatures is read and used as an index of the thermal characteristics of the toner or the binder resin. However, recently the requirement for the low-temperature image fixing performance is increased, so that the importance of the flow curve characteristics is more recognized, and by satisfying the requirement for the four temperature characteristics (Ts, Tfb, T1/2 temperature, and the flow ending temperature), a toner which satisfies the requirement for both the low-temperature image fixing performance and the anti-hot-offset performance can be obtained.

In order to keep a proper balance between the low-temperature image fixing performance and the anti-hot-offset performance which are reciprocal to each other, it is preferable that the toner satisfy the conditions represented by the following formulae (1) and (2):

$$2\times Tfb-Tend-Ts\leqq 15 \quad (1)$$

$$15\leqq Tend-Ts-2\times(T1/2-Tfb)\leqq 40 \quad (2)$$

wherein Ts represents a softening point of the toner, Tfb represents a flow beginning temperature of the toner, Tend represents a flow ending temperature of the toner, and T1/2 represents a fusing temperature of the toner in the T1/2 method.

To further improve the performances of the toner, it is preferable that the binder resin for use in the toner comprise a polyester resin.

When a polyester resin is contained, it is desirable to employ, as a raw material for the polyester resin, an aromatic monomer as much as possible in order to reduce the water content in the obtained toner. For instance, a polyester resin prepared from an alcohol such as a bisphenol - propylene oxide (PO) adduct or a bisphenol - ethyllene oxide (EO) adduct and a carboxylic acid such as terephthalic acid or citric acid is advantageous because the toner is made difficult to absorb water in the air by the polyester resin contained in the toner, so that the water content of the toner can be controlled to be 5,000 ppm or less, and the environmental stability of the obtained toner can be improved. When the polyester resin is prepared from the aromatic materials so as to indicate an acid value in the range of 1 to 5 mgKOH/g, preferably in the range of 1 to 3 mgKOH/g, and a hydroxyl value in the range of 30 to 80 mgKOH/g, preferably in the range of 30 to 60 mgKOH/g, the adsorption of water by the polyester resin can be prevented more effectively, so that it is possible to reduce the water content to 3,000 ppm or less, whereby the environmental stability of the obtained toner can be further improved.

A method of preparing the toner of the present invention will now be explained.

The toner of the present invention can be prepared by applying mechanical shearing force to a cross-linked binder resin which contains a THF-insoluble component, whereby the molecules in a molecular region of the cross-linked binder resin are subjected to molecular chain scission.

More specifically, in this method, a binder resin containing a THF-insoluble component in an amount of 5 to 40 wt. % is kneaded together with carbon black, a charge control agent and other additives, with the application of mechanical shearing energy thereto.

In the present invention, it has been confirmed that when the THF-insoluble component in the binder resin has a degree of swelling of 2 to 20, the obtained image quality, image fixing performance and anti-hot-offset performance can be further improved in the recycle system.

The THF-insoluble component in the binder resin and the degree of swelling thereof will now be explained.

The THF-insoluble component is a gel component with a crosslinked structure, and the swelling thereof is a phenomenon that an elastic gel becomes greater in volume by absorbing a liquid (dispersion medium). The swelling is one of the characteristics of the elastic gel attributable to its structure, namely, due to the cross-linking structure of the THF-insoluble component. The greater the cross-linking density, the smaller the degree of swelling.

The inventors of the present invention have studied the relationship between (1) the degree of swelling of the binder resin, which constitutes one of the characteristics of the cross-linking structure of the binder resin and the strength or hardness of the resin, and (2) image quality characteristics, image fixing performance, anti-hot-offset performance obtained by an electrophotographic method in which a recycle system is adopted, using a toner for developing latent electrostatic images to toner images, and the productivity of a toner, which toner is obtained by fusing and kneading the above-mentioned resin, a coloring agent, a charge controlling agent, and optionally other additives and a releasing agent. As a result, the following novel facts have been discovered:

In a development method using a dry two-component developer in which a latent electrostatic image formed on an image bearing member is developed with the developer to a toner image, the toner image is transferred to an image transfer sheet, a residual toner which remains on the image bearing member is cleaned to return the residual toner to a development unit or to a replenishment toner to reuse the residual toner, in order to accomplish an electrophotographic method which is capable of (1) preventing the toner from being pulverized within the development unit, (2) attaining excellent dispersion of each material in the toner, (3) providing high quality images in a stable manner for an extended period of time, and (4) attaining excellent image fixing performance and excellent anti-hot-offset performance, it is preferable to use a toner which is prepared by fusing and kneading (a) a binder resin comprising a tetrahydrofuran-insoluble component in an amount of 5 to 40 wt. %, the tetra-hydrofuran-insoluble component having a degree of swelling in tetahydrofuran in a range of 2 to 20, (b) a coloring agent, (c) a charge control agent, and optionally other additive and a releasing agent.

The degree of swelling in the above can be defined, when a unit weight of the THF-insoluble component is caused to swell in THF at 10° C. for 20 to 30 hours, as a ratio of the weight of the swelled THF-insoluble component (gel component) to the unit weight of the THF-insoluble component prior to the swelling thereof in THF.

The larger the degree of swelling of the gel component in a solvent, the larger the volume increasing ratio of the gel component in the solvent, with a network structure of the gel component being capable of absorbing the solvent in an amount corresponding to the volume increasing ratio, indicating that each of the meshes of the network of the gel component is extremely large, with a low cross-linking density and a long distance between cross-linking points in the network structure of the gel component.

The smaller the degree of swelling of the gel component in the solvent, the smaller the capability of the gel component of absorbing the solvent, indicating that each of the meshes of the network of the gel component is extremely small, with a high cross-linking density and a short distance between cross-linking points in the network structure of the gel component.

The distance between the cross-linking points is significantly related with the strength of the resin. The shorter the distance, the greater the strength, that is, the harder the gel. The longer the distance, the smaller the strength, that is, the weaker the gel. In other words, the scale of the strength of the resin corresponds to the degree of swelling of the gel component of the resin. In the present invention, it is preferable that the gel component have a degree of swelling in a range of 2 to 20 in view of the quality of the toner to be produced and the productivity of the toner.

When a resin with a degree of swelling of less than 2, the toner prepared using the resin tends to have high cohesive force, so that the toner is difficult to be pulverized while in use, and has excellent anti-hot-offset performance. However, the image fixing performance of the toner is poor. Furthermore, when the resin with a degree of swelling of less than 2 is used, the molecular chain scission is difficult to take place in the resin because of the high strength of the gel component of the resin, so that the materials for producing the toner have to be supplied slowly in the course of the production of the toner in order to obtain the required molecular weight distribution of the toner in the present invention, and accordingly the productivity of the toner is reduced. Furthermore, the dispersibility of the resin with other materials is so poor that it may occur that the carrier is contaminated, for instance, with way used as a releasing agent. This has adverse effects on the toner produced.

When a resin with a degree of swelling of 20 or more is used in the production of the toner, the resin is apt to be subjected to molecular chain scission in the course of the kneading process, so that the cohesive force of the resin tends to be reduced and accordingly the produced toner is easily and excessively pulverized while in use. Furthermore, due to the reduction in the cohesive force, a torque during the kneading process is lowered, and accordingly the dispersibility of the resin with other materials is so poor that a coloring agent tends to be aggregated, and the resin tends to form boundary surfaces which become pulverizing points. Accordingly, the toner is further pulverized within the developer when the developer is stirred at the process of development. The result is that the powder characteristics and charging characteristics of the toner are changed, and the deposition of toner particles on the background of images is caused and the cleaning performance thereof becomes improper. In this case, the dispersibility of a charge control agent is also impaired, so that the toner particles are not uniformly charged, and weakly charged toner particles are formed. Due to the reduction in the cohesive force of the toner, the image fixing performance of the toner is improved, but the anti-hot-offset performance thereof is impaired.

It is preferable that the resin contain the THF-insoluble component in an amount of 5 to 40 wt. %. When the content of the THF-insoluble component is less than 5 wt. %, the image fixing performance of the toner prepared using the resin is good, but the anti-hot-offset performance thereof is poor, while when the content of the THF-insoluble component exceeds 40 wt %, the anti-hot-offset performance of the toner is good, but the image fixing performance thereof is poor, and the productivity of the toner is reduced because the materials for producing the toner cannot be speedily supplied in the course of the kneading process for producing the toner.

Thus, in the development method using a dry two-component developer in which a latent electrostatic image is formed on an image bearing member and developed with the developer to a toner image, the toner image is transferred to an image transfer sheet, a residual toner which remains on the image bearing member is cleaned to return the residual toner to the development unit or to a replenishment toner to reuse the residual toner, it is preferable that the resin contain the THF-insoluble component in an amount of 5 to 40 wt. % and that the THF-insoluble component have a degree of swelling of 2 to 20, in order to accomplish an electrophotographic method which is capable of (1) preventing the toner from being pulverized within the development unit, (2) attaining excellent dispersion of each material in the toner, (3) providing high quality images in a stable manner for an extended period of time, and (4) attaining excellent image fixing performance and excellent anti-hot-offset performance as mentioned above.

In the kneading process, the materials for producing the toner are premixed in a mixer such as a V-shape blender or a Henschel mixer, and then kneaded using a heat-application roller, a pressure-application kneader, a Bumbury's mixer, or a one- or two-axis blending machine, usually at a temperature of 100° C. to 200° C.

In the kneading process, there is a region in which the molecules of the binder resin are subjected to scission by the application of mechanical shearing energy to the toner composition in the kneading process. The scission of the molecules is mainly determined by the viscosity of the toner composition during the kneading process. It is appropriate that such a viscosity of the toner composition in the kneading process is in the range of $10^4$ to $10^7$ poise. When the viscosity of the toner composition is lower than $10^4$ poise at the kneading process, the scission of the molecules is so difficult to occur that the THF-insoluble component remains in the toner. When the viscosity of the toner composition is greater than $10^7$ poise, the binder resin cannot be sufficiently dispersed with other materials, and in addition, the load applied to the kneader becomes so high that there is a risk of the kneader being mechanically damaged.

It is considered that a polymeric material having a network structure with a weight-average molecular weight of about $1\times10^6$ or more is subjected to the above-mentioned molecular chain scission.

Figure 1B:
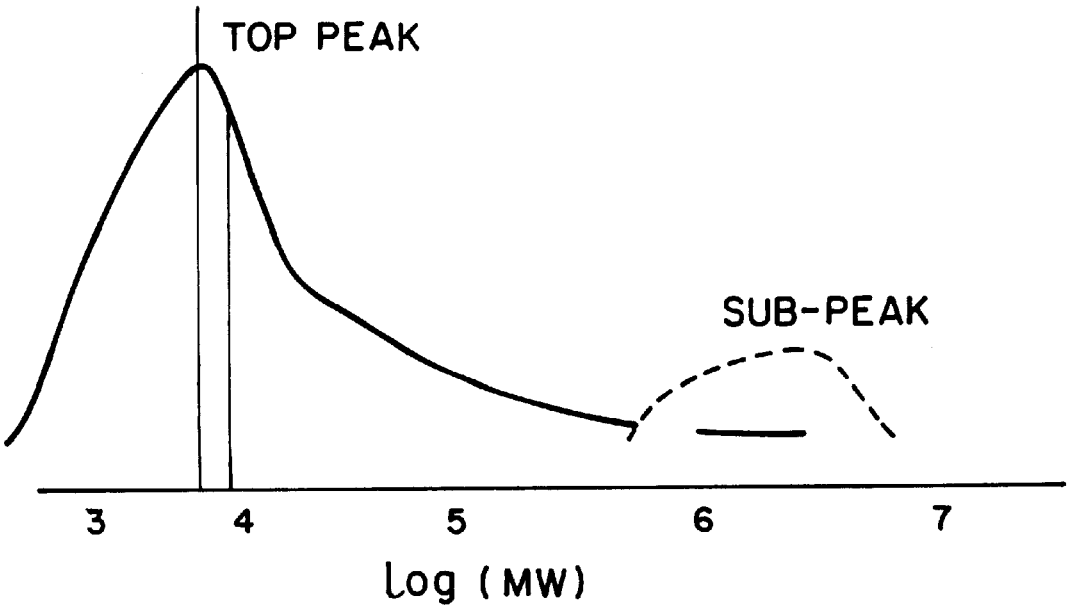

In particular, when the THF-insoluble component with a weight-average molecular weight of about $1\times10^7$ or more, which is an upper limit for the measurement by GPC, is subjected to the above-mentioned molecular chain scission, a sub-peak appears in a region near $1\times10^6$ to $1\times10^7$ in addition to a top peak as shown in a graph shown in FIG. 1(*b*).

FIG. 1(*a*) is a graph of a molecular distribution measured by GPC corresponding to the above when the above-mentioned THF-insoluble component has not yet subjected to the molecular chain scission. In this case, only the top peak appears, but no sub-peak appears as shown in FIG. 1(*b*).

When the molecular weight distribution of the toner composition before the kneading process is compared with that after the kneading process, there is no change in the molecular weight distribution of a weight-average molecular weight of about $1\times10^4$ or less. Such molecular chain scission is difficult to achieve by synthesis.

As a result of the above-mentioned kneading accompanied by the molecular chain scission, the binder resin exhibits a sub-peak within a weight-average molecular weight range of 100,000 to 10,000,000 in a molecular weight distribution measured by the GPC. Such a sub-peak is not observed in the molecular weight distribution before the kneading process. This sub-peak serves as an index of the recyclable toner for the improvement of the anti-hot offset performance and the prevention of pulverization of toner particles within the copying apparatus. Further, it is preferable that the binder resin exhibit a top peak in a weight-average molecular weight range of 5,000 to 10,000, more preferably 5,000 to 8,000, with 35 to 55% thereof having a weight-average molecular weight of 10,000 or less. This is because when the top peak is in a weight-average molecular weight range of less than 5,000, the pulverizing of the toner particles is apt to take place, while when the top peak is in a weight-average molecular weight range of more than 10,000, the low-temperature image fixing performance tends to be gradually lowered.

A method of measuring the molecular weight distribution by the gel permeation chromatography (GPC) will now be explained in detail.

A GPC column is stabilized at 40° C. in a temperature controlled chamber, and tetrahydrofuran serving as a solvent is caused to flow through the column at a flow rate of 1 ml/mm. 50 to 200 ml of a solution of a sample resin in tetrahydrofuran, prepared so as to contain therein the sample resin with a concentration of 0.05 to 0.6 wt. %, is injected into the column for the measurement of the molecular weight distribution thereof.

In measuring the molecular weight distribution of the sample resin, the molecular weight distribution of the sample resin is calculated from the relationship between the counted values and logarithmic values of a calibration curve obtained from several kinds of monodisperse polystyrene standard samples with different molecular weights. In this case, it is appropriate to employ at least about ten kinds of polystyrene standard samples with different molecular weights for preparation of the calibration curve. For example, there can be employed monodisperse polystyrene samples with molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$, which are available from Pressure Chemical Co., or Toyo Soda Co. For the measurement, a refractive-index type detector is generally used. In such measurement, it is difficult to determine the molecular weight of $1\times10^7$ or more by using a currently employed GPC column. In the present invention, when the ratio of the THF-soluble component having a weight-average molecular weight of 10,000 or less is obtained from a chart area obtained by plotting the molecular weight distribution, using GPC. It is preferable that 35 to 55% of the THF-soluble component have a weight-average molecular weight of 10,000 or less in terms of the above-mentioned chart area in the present invention.

Specific examples of such a binder resin for use in the present invention include homopolymers of styrene or substituted styrenes such as polystyrene, poly-p-chlorostyrene, and polyvinyltoluene; styrene copolymers such as styrene - p-chlorostyrene copolymer, styrene - propylene copolymer, styrene - vinyltoluene copolymer, styrene - vinylnaphthalene copolymer, styrene - methyl acrylate copolymer, styrene - ethyl acrylate copolymer, styrene - butyl acrylate copolymer, styrene - octyl acrylate copolymer, styrene - methyl methacrylate copolymer, styrene - ethyl methacrylate copolymer, styrene - butyl methacrylate copolymer, styrene - methyl α-chloromethacrylate copolymer, styrene - acrylonitrile copolymer, styrene - vinyl methyl ketone copolymer, styrene - butadiene copolymer, styrene - isoprene copolymer, styrene - acrylonitrile - indene copolymer, styrene - maleic acid copolymer, and styrene - maleic acid ester copolymer; and poly(methyl methacrylate), poly(butyl methacrylate), polyvinyl chloride, polyvinyl acetate, polyethylene, polypropylene, polyester, epoxy resin, epoxy polyol resin, polyurethane, polyamide, polyvinyl butyral, polyacrylic resin, rosin, modified rosin, terpene resin, aliphatic or alicyclic hydrocarbon resin, aromatic petroleum resin, chlorinated paraffin, and paraffin wax. These binder resins may be used alone or in combination.

In particular, it is preferable that the binder resin for use in the toner of the present invention comprise a polyester resin, as mentioned above. The polyester resin for use in the present invention comprises as structural units a polycarboxylic acid component (A) and a polyol component (B).

Further, it is preferable that a vinyl resin in an amount of 30 wt. % or less be blended with the polyester resin in the binder resin from the viewpoints of the resistance to vinyl chloride materials, the environmental stability of the charging of the toner, and the image fixing performance of the toner.

The addition of the vinyl resin, particularly a styrene-based copolymer prepared from styrene and an acrylic monomer, a methacrylic monomer, or butadiene, to the binder increases the hydrophobic nature of the binder, so that when the binder resin composed of the polyester and the vinyl resin is used in the toner, the environmental stability of the toner is more improved in comparison with the case where only the polyester resin is used as the binder resin for use in the toner.

When the amount of the vinyl resin in the binder resin exceeds 30 wt. %, the resistance of toner images to a vinyl chloride mat is lowered and the image fixing performance of the toner is degraded.

The polycarboxylic acid component (A) includes a dicarboxylic acid (A1) and an acid having three or more carboxyl groups in a molecule thereof (A2).

Specific examples of the dicarboxylic acid (A1) include:

(1) aliphatic dicarboxylic acids having 2 to 20 carbon atoms, such as maleic acid, fumaric acid, succinic acid, adipic acid, sebacic acid, malonic acid, azelaic acid, mesaconic acid, citraconic acid, and glutaconic acid;

(2) alicyclic dicarboxylic acids having 8 to 20 carbon atoms, such as cyclohexanedicarboxylic acid;

(3) aromatic dicarboxylic acids having 8 to 20 carbon atoms, such as phthalic acid, isophthalic acid, terephthalic acid, toluenedicarboxylic acid, and naphthalenedicarboxylic acid; and (4) alkyl succinic acids or alkenyl succinic acids of which the side chain has a hydrocarbon group having 4 to 35 carbon atoms, such as isododecenyl succinic acid and n-dodecenyl succinic acid, and anhydrides and lower alkyl (methyl or butyl) esters of the above-mentioned dicarboxylic acids.

Of the above-mentioned dicarboxylic acids (A1), dicarboxylic acids (1), (3) and (4), and anhydrides and lower alkyl esters thereof are preferably employed in the present invention. In particular, maleic acid, maleic anhydride, tumaric acid, isophthalic acid, terephthalic acid, dimethylterephthalate, and n-dodecenyl succinic acid and an anhydride thereof are most preferable. To be more specific, maleic acid, maleic anhydride, and fumaric acid are preferred for their high reactivity; and isophthalic acid and terephthalic acid are preferred because it is possible to obtain a high glass transition temperature of the obtained polyester resin.

Specific examples of the polycarboxylic acid (A2) having three or more carboxyl groups include:

(1) aliphatic polycarboxylic acids having 7 to 20 carbon atoms, such as 1,2,4-butanetricarboxylic acid, 1,2,5-hexanetricarboxylic acid, 1,3-dicarboxyl-2-methyl-2-methylenecarboxypropane, tetra(methylenecarboxyl) methane, and 1,2,7,8-octanetetracarboxylic acid;

(2) alicyclic polycarboxylic acids having 9 to 20 carbon atoms, such as 1,2,4-cyclohexanetricarboxylic acid, and (3) aromatic polycarboxylic acids having 9 to 20 carbon atoms, such as 1,2,4-benzenetricarboxylic acid, 1,2,5-benzenetricarboxylic acid, 2,5,7-naphthalenetricarboxylic acid, 1,2,4-naphthalenetricarboxylic acid, pyromellitic acid, and benzophenonetetracarboxylic acid, and anhydrides and lower alkyl (methyl or butyl) esters thereof.

Of the above-mentioned polycarboxylic acids (A2), the aromatic polycarboxylic acids (3), and anhydrides and lower alkyl esters thereof are preferably employed in the present invention. In particular, 1,2,4-benzenetricarboxylic acid and 1,2,6-benzenetricarboxylic acid, and anhydrides and lower alkyl esters thereof are more preferable from the viewpoint of cost and the off-set resistance of the obtained toner.

It is preferable that the polycarboxylic acid component (A) comprise the polycarboxylic acid (A2) having three carboxyl groups or more in an amount from 0 to 30 mol %, more preferably from 0 to 20 mol %, and further preferably from 0 to 10 mol %.

The polyol component (B) for the preparation of the polyester resin includes a dihydroxy alcohol (B1) and polyhydroxy alcohol having three or more hydroxyl groups (B2).

Specific examples of the dihydroxy alcohol (B1) include:

(1) alkylene glycols having 2 to 12 carbon atoms, such as ethylene glycol, 1,2-propylene glycol, 1,3-propylene glycol, 1,4-butane diol, neopentyl glycol, 1,4-butene diol, 1,5-pentane diol, and 1,6-hexane diol;

(2) alkylene ether glycols, such as diethylene glycol, triethylene glycol, dipropylene glycol, polyethylene glycol, polypropylene glycol, and polytetramethylene glycol;

(3) alicyclic diols having 6 to 30 carbon atoms, such as 1,4-cyclohexane dimethanol and hydrogenated bisphenol A;

(4) bisphenols, such as bisphenol A, bisphenol F and bispbenol S; and (5) adducts of the above-mentioned bisphenol with 2 to 8 moles of an alkylene oxide, such as ethylene oxide, propylene oxide, or butylene oxide.

Of the above-mentioned dihydroxy alcohols (B1), dihydroxy alcohols (1) and (5) are preferably employed in the present invention, and in particular, the dihydroxy alcohols (5) are more preferable. More specifically, of the dihydroxy alcohols (1), ethylene glycol is preferred due to fast reaction speed, and both 1,2-propylene glycol and neopentyl glycol are preferred from the viewpoint of low-temperature image fixing performance. Of the dihydroxy alcohols (5), adducts of bisphenol A with 2 to 4 moles of ethylene oxide and/or 1,2-propylene oxide are more preferable because excellent off-set resistance can be imparted to the obtained toner.

Specific examples, of the polyhydroxy alcohol (B2) having three or more hydroxyl groups include:

(1) aliphatic polyhydroxy alcohols having 3 to 20 carbon atoms, such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropane triol, 2-methyl-1,2,4-butanetriol, trimethylolethane, and trimethylolpropane; and (2) aromatic polyhydroxy alcohols having 6 to 20 carbon atoms, such as 1,3,5-trihydroxylmethylbenzene, and alkylene oxide adducts of the above-mentioned aromatic polyhydroxy alcohols.

Of the polyhydroxy alcohols (B2), the aliphatic polyhydroxy alcohols (1) are preferably employed. In particular, glycerol, trimethylolpropane and pentaerythritol erythritol are more preferable because they are not expensive.

It is preferable that the polyol component (B) comprise the polyhydroxy alcohol (B2) having three hydroxyl groups or more in an amount from 0 to 20 mol %, more preferably from 0 to 10 mol %, and further preferably from 0 to 5 mol %.

The vinyl resin which may be blended with the previously mentioned polyester resin will now be explained in detail.

To produce vinyl polymers, not only styrene, but also vinyl monomers having a vinyl group in a molecule thereof can be employed. For example, there are styrene derivatives such as α-methylstyrene, p-methylstyrene, p-tert-butylstyrene, and p-chlorostyrene; methacrylic acid, methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, undecyl methacrylate, dodecyl methacrylate, glycidyl methacrylate, methoxethyl methacrylate, propoxyethyl methacrylate, butoxyethyl methacrylate, methoxydiethylene glycol methacrylate, ethoxydiethylene glycol methacrylate, methoxyethylene glycol methacrylate, butoxytriethylene glycol methacrylate, methoxydipropylene glycol methacrylate, phenoxyethyl methacrylate, phenoxydiethylene glycol methacrylate, phenoxytetraethylene glycol methacrylate, benzyl methacrylate, cyclohexyl methacrylate, tetrahydrofurfuryl methacrylate, dicyclopentenyl methacrylate, dicyclopentenyloxyethyl methacrylate, N-vinyl-2-pyrrolidone methacrylate, methacrylonitrile, methacrylamide, N-methylolmethacrylamide, 2-hydroxyethyl methacrylate, hydroxypropyl methacrylate, hydroxybutyl methacrylate, 2-hydroxy-3-phenyloxypropyl methacrylate, diacetone acrylamide, acrylic acid, methyl acrylate, ethyl acrylate, propyl acrylate, butyl acrylate, pentyl acrylate, hexyl acrylate, heptyl acrylate, octyl acrylate, nonyl acrylate, decyl acrylate, undecyl acrylate, dodecyl acrylate, glycidyl acrylate, methoxyethyl acrylate, propoxyethyl acrylate, butoxyethyl acrylate, methoxydiethylene glycol acrylate, ethoxydiethylene glycol acrylate, methoxyethylene glycol acrylate, butoxytriethylene glycol acrylate, methoxydipropylene glycol acrylate, phenoxyethyl acrylate, phenoxydiethylene glycol acrylate, phenoxytetraethylene glycol acrylate, benzyl acrylate, cyclohexyl acrylate, tetrahydrofurfuryl acrylate, dicyclopentenyl acrylate, dicyclopentenyloxyethyl acrylate, N-vinyl-2-pyrrolidone acrylate, hydroxyethyl acrylate, hydroxypropyl acrylate, hydroxybutyl acrylate, 2-hydroxy-3-phenyloxypropyl acrylate, glycidyl acrylate, acrylonitrile, acrylamide, N-methylolacrylamide, diacetone acrylamide, and vinylpyridine.

In addition to the above, there can be employed vinyl monomers having two or more vinyl groups in a molecule thereof, for example, divinylbenzene, and reaction products of glycol and methacrylic acid or acrylic acid, such as ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentyl glycol dimethacrylate, diethylene glycol dimethacrylate, triethylene glycol dimethacrylate, polyethylene glycol dimethacrylate, tripropylene glycol dimethacrylate, trimethylolethane trimethacrylate, trimethylolpropane trimethacrylate, pentaerythrite trimethacrylate, pentaerythrite tetramethacrylate, trismethacryloxyethyl phosphate, bis(methacryloyloxyethyl)hydroxyethyl isocyanurate, tris(methacryloloxyethyl)isocyanurate, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, polyethylene glycol diacrylate, tripropylene glycol diacrylate, hydroxypivalic acid neopentyl glycol diacrylate, trimethylolethane triacrylate, trimethylolpropane triacrylate, pentaerythrite triacrylate, pentaerythrite tetraacrylate, trisacryloxyethyl phosphate, half esters of glycidyl methacrylate and methacrylic acid or acrylic acid, half esters of bisphenol type epoxy resin and methacrylic acid or acrylic acid, and half esters of glycidyl acrylate and methacrylic acid or acrylic acid.

Of the above-mentioned vinyl monomers having one vinyl group in a molecule thereof, styrene, styrene derivatives, methacrylate, and acrylate are preferably employed. In particular, styrene, and alkyl esters of methacrylic acid or acrylic acid in which the alkyl group has 1 to 5 carbon atoms are most preferable.

Of the above-mentioned vinyl monomers having two or more vinyl groups in a molecule thereof, divinylbenzene, and dimethacrylate or diacrylate of methylene glycol having 2 to 6 carbon atoms are preferably employed.

It is preferable that the vinyl monomer comprise a vinyl monomer having two or more vinyl groups in a molecule thereof in an amount of 0.1 to 1 wt. %.

The previously mentioned monomers or monomer mixtures may be subjected to polymerization, for example, suspension polymerization, solution polymerization, emulsion polymerization, or bulk polymerization. In light of the economic factor and the reaction stability, it is advantageous to employ the aqueous suspension polymerization.

A radical polymerization initiator is employed for the polymerization of those monomers or monomer mixtures. Examples of the initiator of polymerization are as follows: peroxides such as benzoyl peroxide, 2-ethylhexyl perbenzoate, lauroyl peroxide, acetyl peroxide, isobutyryl peroxide, octanoyl peroxide, di-tert-butyl peroxide, tert-butyl peroxide, cumene hydroperoxide, methyl ethyl ketone peroxide, 4,4,6-trimethylcyclohexanone di-tert-butyl peroxyketal, cyclohexanone peroxide, methylcyclohexanone peroxide, acetylacetone peroxide, cyclohexanone di-tert-butyl peroxyketal, 2-octanone di-tert-butyl peroxyketal, acetone di-tert-butyl peroxyketal, and diisopropylbenzene hydroperoxide; and azobis compounds such as 2,2'-azobisisobutyronitrile, 2,2'-azobis-(2,4-dimethylvaleronitrile), 2,2'-azobis(4-methoxy-2,4-dimethylvaleronitrile), dimethyl 2,2'-azobis(isobutyrate), and 1,1'-azobis(cyclohexane-1-carbonitrile).

It is preferable that the amount of radical polymerization initiator be in the range of 0.01 to 20 wt. %, more preferably in the range of 0.1 to 10 wt. %, of the total weight of the monomers.

In addition, a radical polymerization molecular weight modifier may be used in the course of the polymerization. Examples of the molecular weight modifier are mercaptans such as butyl mercaptan, octyl mercaptan, dodecyl mercaptan, methyl 2-mercaptopropionate, ethyl 2-mercaptopropionate, butyl 2-mercaptopropionate, octyl 2-mercaptopropionate, pentaerythrite tetra(2-mercaptopropionate, ethyleneglycol di(2-mercaptopropionate), and glycerin tri(2-mercaptopropionate); and halogenated hydrocarbons such as chloroform, bromoform, and carbon tetrabromide.

It is preferable that the amount of molecular weight modifier be in the range of 0 to 3 wt. % of the total weight of the monomers.

To perform the aqueous suspension polymerization, there can be employed water-soluble polymeric dispersant, such as partially saponified polyvinyl alcohol, alkyl cellulose, hydroxyalkyl cellulose, carboxyalkyl cellulose, polyacrylamide, polyvinyl pyrrolidone, polyacrylic acid and alkali metal salts thereof, and polymethacrylic acid and alkali metal salts thereof; and slightly soluble inorganic dispersant, such as calcium phosphate, hydroxyapatite, magnesium phosphate, magnesium pyrophosphate, calcium carbonate, barium sulfate, and hydrophobic silica.

With respect to the amount of dispersant, it is preferable that the water-soluble polymeric dispersant be contained in an amount of 0.0001 to 5 wt. % of the total weight of the employed aqueous medium, and that the slightly soluble inorganic dispersant be contained in an amount of 0.01 to 15 wt. % of the total weight of the aqueous medium.

The method of measuring the water content in the binder resin will now be explained in detail. A sample resin is first pulverized to such a degree that the particle size reaches about 200 $\mu$m or less, and then allowed to stand at 30° C. and 6%RH for 24 hours. The water content in the sample resin particles is measured by Karl Fischer's method, using a Karl Fischer's water content titration utensil.

The previously mentioned binder resin is mixed and stirred with a coloring agent and/or a magnetic powder, and a charge control agent, and optionally with other additives. The thus obtained mixture is fused and kneaded, whereby a toner for developing a latent electrostatic image for use in an image method in which a toner recycle system is adopted.

As the coloring agent for use in the present invention, any conventional coloring agents such as carbon black, iron oxide, phthalocyanine blue, phthalocyanine green. Rhodamine 6G Lake, and Watchung Red strontium can be employed. It is preferable that the amount of the coloring agent be in the range of 1 to 60 wt. % of the total weight of the toner for use in the toner recycle system.

Specific examples of the charge control agent for use in the present invention include nigrosine dye, aliphatic acid modified nigrosine dye, metal-containing nigrosine dye, metal-containing aliphatic acid modified nigrosine dye, and chromium complex of 3,5-di-tert-butyl salicylate. The amount of the charge control agent is preferably in the range of 0 to 20 wt. % of the total weight of the toner.

Various waxes with melting points ranging from 70 to 170° C. are usable as the releasing agent in the present invention.

Specific examples of the releasing agent includes carnauba wax, montan wax, sazol wax, paraffin wax, low-molecular weight polyethylene, low-molecular weight polypropylene, and ethylene - vinyl acetate copolymer. The amount of releasing agent is preferably in the range of 1 to 10 wt. % of the total weight of the toner.

One of the research topics concerning the toner for use in the toner recycle system is to improve the anti-hot-offset performance. For this object, polypropylene and polyethylene are conventionally contained in the toner composition. However, in the conventional toner recycle system, the toner particles which have been subjected to development process and recycled are vulnerable to changes in such a way that the size of the toner particles is decreased and the surface appearance of the toner particles is changed because the particles have been crushed. Therefore, the wax initially added as the releasing agent to the toner composition is not favorably exposed, thereby lowering the anti-hot-offset performance of toner. Another countermeasure is thus required.

The addition of waxes to the toner can impart the release properties to the obtained toner, so that it is sure that the anti-hot-offset performance is improved. However, due to poor compatibility of the wax with the binder resin, the development performance of the obtained toner deteriorates as the amount of wax is increasing. In addition, too much amount of wax causes the spent phenomenon with a carrier, thereby making the charge quantity of toner insufficient and unstable. The less the amount of wax, the better for the charging performance.

Japanese Laid-Open Patent Application 9-25127 discloses that it is advantageous that the wax for use in the toner has a particle size of 2 $\mu$m or less when observed using a transmission type electron microscope. In the toner recycle system, the ratio of the wax particles appearing on the surface portion of the toner particles is lowered as mentioned above. In the present invention, therefore, it is preferable that the particle size of the wax be 5 $\mu$m or less, more preferably in the range of 2 to 4 $\mu$m because the anti-hot offset performance is improved in the toner recycle system. When all the wax particles have a particle size of 1 $\mu$m or less, the anti-hot-offset improving effect is reduced.

It is preferable that the viscosity of the toner composition is controlled so as to be $1\times10^4$ to $1\times10^7$ poise in the kneading process in order to disperse the wax component with a particle size of 5 $\mu$m or less.

Further, the toner of the present invention may comprise other additives, such as silica powder, hydrophobic silica powder, polyolefin, paraffin wax, fluorcarbon compounds, fatty esters, partially-saponified fatty esters, and fatty acid metallic salts. These additives may be preferably contained in the toner in an amount of 0.1 to 5 wt. % of the total weight of the toner.

A method of preparing a toner of the present invention which comprises a polyolefin wax dispersed therein will now be explained.

The dispersibility of the polyolefin wax in the binder is remarkably improved by the presence of the THF-insoluble component in the binder resin. This is because the presence of the THF-insoluble component in the binder resin has a significant relationship with the rheological properties of the binder resin. Polymer is a typical material which exhibits a viscoelastic behavior.

In the preparation of toner of the present invention, which exhibits the sub-peak, the binder resin including the polyester resin, optionally with the addition of the vinyl resin thereto, has a cross-linked structure before the binder resin is subjected to the above-mentioned molecular chain scission. When the binder resin is subjected to the molecular chain scission during the kneading process, the binder resin is caused to have a branched structure.

During the kneading process, the binder resin exhibits a large storage viscoelastic modulus (G'), and the kneading process is generally carried out at a temperature in the range of 100 to 200° C. It is known that a polymer with such a branched structure does not flow even in the above-mentioned temperature range, and maintains an elastically of at least about $10^9$ dyne/cm$^2$. This condition is suitable for dispersing the polyolefin in a finely dispersed state in the binder resin.

In contrast to the above, in the preparation of a toner without exhibiting the sub-peak, which is prepared, for instance, by using a linear polymer, it is known that the binder resin does flow under general kneading conditions, and the elasticity thereof approaches zero as the kneading process proceeds.

Toners prepared using the polyolefin wax have been conventionally proposed so far. However, in many cases, in the conventional toners, the compatibility of the polyolefin wax with the binder resin is so poor that the dispersibility of the polyolefin in the binder resin is also poor.

In contrast to this, a polyolefin wax with a particle size of 5 $\mu$m or less, preferably 1 to 5 $\mu$m, can be sufficiently dispersed in the binder resin system with the cross-linked structure, which comprises the polyester, optionally with the vinyl resin blended therewith. This is because the above-mentioned binder resin system exhibits a suitable viscoelastic behavior for the kneading process. When the particle size of the wax particles exceeds 5 $\mu$m, the carrier is contaminated with the wax. In this case, the toner exhibits high durability, but the charging performance thereof is so poor that the quality of the image obtained by the toner is degraded.

A two-component developer comprising carrier particles and toner particles is conventionally known. The carrier for use in the two-component developer is required to triboelectrically charge the toner constantly with a desired polarity and with a sufficient charge quantity for an extended period of time. In order to obtain a two-component developer which exhibits stable chargeability, using the toner of the present invention by which the carrier is not contaminated with a wax component and additives contained in the toner, it is preferable that the toner of the present invention be used in combination with a silicone-resin coated carrier.

In particular, since that the toner has excellent charging stability is indispensable for securing the durability of the developer, the combined use of the toner of the present invention with the silicone-resin coated carrier has a great effect on the extension of the durability of the developer.

To prepare a silicone-resin coated carrier, for example, commercially available silicone resins such as "KR271" and "KR225" (Trademarks) made by Shin-Etsu Chemical Co., Ltd., can be employed. As a core material for the carrier, sand, cobalt, iron, ferrite and magnetite, each having an average particle size of 50 to 20 $\mu$m, can be preferably employed. A silicone-resin coating layer for the carrier particles can be formed, for example, by a spraying method.

The application of the toner of the present invention to the above-mentioned dry two-component developer will now be explained in more detail.

The toner for the dry two-component developer is prepared in the same manner as for the conventional toner in general use by mixing a coloring agent, a binder resin, and a charge control agent, which serve as the main components of the toner, and pulverizing the mixture. To be more specific, the respective amounts of the above-mentioned components for the toner are mixed, fused and kneaded. The mixture is then cooled and pulverized, whereby the toner for the dry two-component developer is prepared. Alternatively, the coloring agent, the binder resin and a solvent are mixed in a ball mill, and the resultant mixture is spray-dried, whereby the toner for the dry two-component developer is prepared.

When the thus obtained toner is used, for instance, in the cascade development and the magnetic brush development, it is preferable that the toner have an average particle size of about 30 $\mu$m or less, more preferably, an average particle size in the range of 4 to 15 $\mu$m for achieving the best results.

Coated carrier particles and non-coated carrier particles for use in the cascade development method and the magnetic brush development are conventionally known. As long as the toner particles are such that when the toner particles are attached to the surfaces of the carrier particles, and the toner particles and the carrier particles are in close contact with each other in such a manner that the carrier particle surround the toner particles, the toner particles gain electric charges with a polarity opposite to that of the charges of the carrier particles, the carrier particles may be made of any material. Therefore, the toner of the present invention can be used by being mixed with any conventional carrier for developing a latent electrostatic image formed on the surface of a conventional photoconductor.

The image formation method of the present invention will now be explained, using the above prepared toner for recycling in a development unit provided with a recycling mechanism, with reference to FIG. 3.

Figure 3:
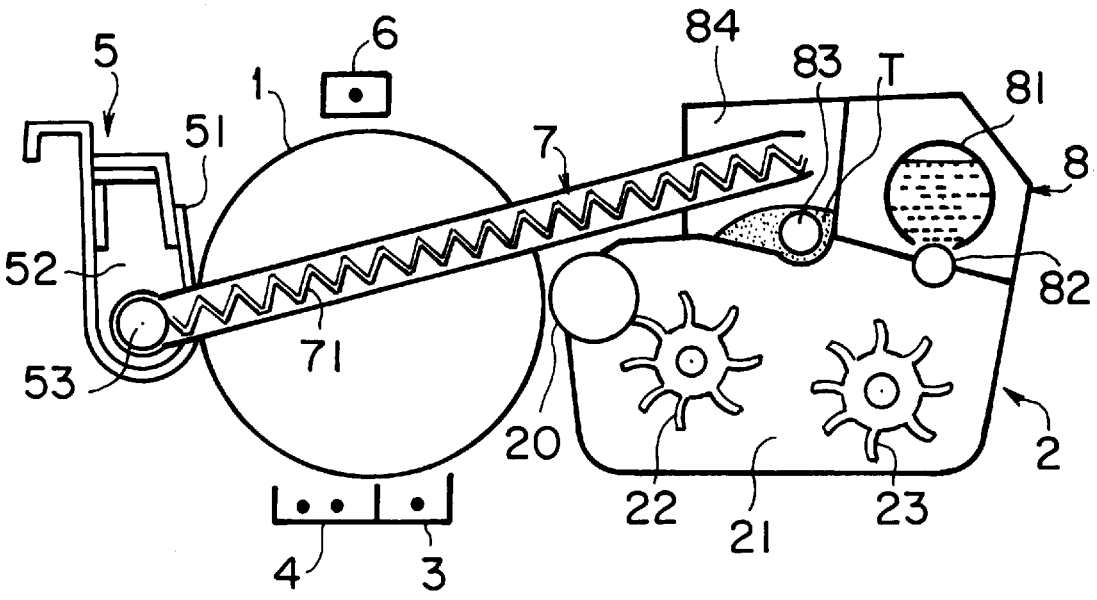
FIG. 3 is a schematic cross-sectional view of an example of a copying machine provided with a toner recycle system.

In FIG. 3, around a photoconductor drum 1 which serves as an image bearing member are situated a development unit 2, an image transfer charger 3 for applying electric charges to an image transfer sheet when a toner image formed on the photoconductor drum 1 is transferred to the image transfer sheet, a sheet separation charger 4 for applying electric charges to the image transfer sheet when the image transfer sheet is separated from the surface of the photoconductor drum 1, a cleaning unit 5 for cleaning the surface of the photoconductor drum 1 to remove a residual toner from the surface of the photoconductor drum 1, and a main charger 6 for charging the surface of the photoconductor drum 1.

A toner transport unit 7 for transporting a recovered toner from the cleaning unit 5 to the development unit 2 is provided so as to connect the cleaning unit 5 and the development unit 2.

The development unit 2 is composed of a toner supplying section 8 provided with a toner cartridge 81 for supplying the toner, a developer tank 21 serving as a tank for holding a developer therein, provided with stirring screws 22 and 23 and a development roller 20, and a hopper 84 for a recycled toner.

At the bottom of the toner supplying section 8, there is disposed a first toner supply roller 82 for supplying the toner to the developer tank 21.

At the bottom of the hopper 84 for the recycled toner, there is disposed a second toner supply roller 83 for supplying the recycled toner to the developer tank 21.

The cleaning unit 5 includes a toner recovering chamber 52, a first toner transporting coil 53, which is a screw-shaped rotating member and rotatably supported by a pair of front and back side walls for the cleaning unit 5, and a cleaning blade 51. A second toner transporting coil 71 with the same shape as that of the first toner transporting coil 53 is disposed within the toner transport unit 7. The cleaning unit 5, the toner transport unit 7, the hopper 84 for the recycled toner, and the second toner supply roller 83 constitute a toner recycling apparatus.

The second toner supply roller 83, the first toner supply roller 82, the first toner transport coil 53, and the second toner transport coil 71 are connected to a driving mechanism (not shown) so as to be driven in rotation. In this structure, the photoconductor drum 1 is rotated clockwise, and a latent electrostatic image is formed on the photoconductor drum 1 by a charging operation of the main charger 6 and an exposure operation (not shown). The latent electrostatic image is developed to a toner image by the development unit 2. The toner image formed on the photoconductor drum 1 is transformed to an image transfer sheet by the image transfer charger 3 and the sheet separation charger 4. The toner image is then fixed to the image transfer sheet by an image fixing unit (not shown).

After the image transfer operation, a residual toner remaining on the photoconductor drum 1 is then removed by the cleaning blade 51 so as to clean the surface of the photoconductor drum 1. The removed toner is recovered in the toner recovering chamber 52. The recovered toner T in the toner recovering chamber 52 is transported into the hopper 84 of the development unit 2 by the first toner transport coil 53 and the second toner transport coil 71 and placed in the developer tank 21.

Figure 4:
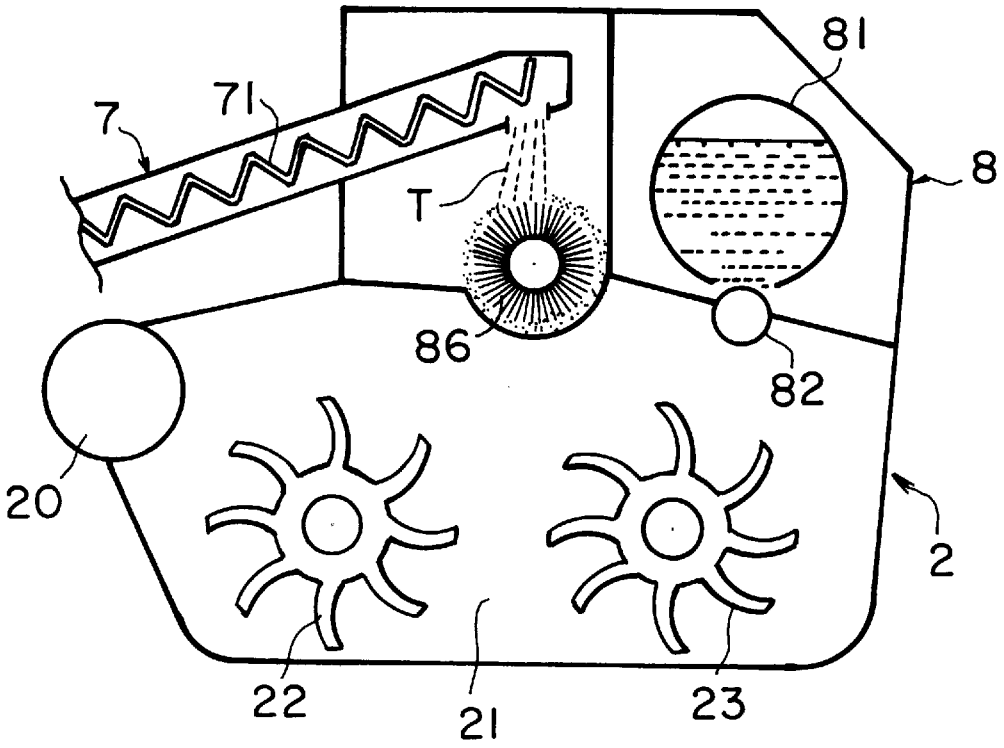
FIG. 4 is a partial enlarged cross-sectional view of the copying machine as shown in FIG. 3.

The operation of the toner recycling apparatus will now be explained with reference to FIG. 3 and FIG. 4.

The toner T, recovered by the cleaning blade 51 of the cleaning unit 5, is dropped into the toner recovering chamber 52, and is then moved to a front side or a back side of the photoconductor drum 1 by the rotating first toner transport coil 53. The recovered toner T, which has been moved to the front side or the back side of the photoconductor drum 1, is transported to the hopper 84 of the development unit 2 by the rotating second toner transport coil 71 in the toner transport unit 7, and is then dropped at the bottom of the toner supplying section 8. The recovered toner T is then supplied to the developer tank 21 by the rotating second toner supply roller 83.

The toner thus recovered from the two-component developer, using the toner recycling apparatus, is subjected to stirring stress in the course of the transportation thereof to the toner supply section, and by the toner supply rollers, or within the developer tank. However, the toner of the present invention matches with the above-constructed toner recycling apparatus in performance, whereby there has been attained the image formation method of the present invention, which is capable of preventing the toner particles from being pulverized, and also capable of preventing the quality of the toner from being caused to deteriorate by the changes in the surface state of the toner particles, without causing the deterioration of the quality of the toner by the changes in the environmental conditions.

Other features of this invention will become apparent in the course of the following description of exemplary embodiment, which are given for illustration of the invention and are not intended to be limiting thereof.

EXAMPLE 1

A mixture of the following components was fused and kneaded at 130° C. for 30 minutes using a two-roll mill.

| | Parts by Weight |
|---|---|
| Polyester resin I (shown in TABLE 1) | 240 |
| Vinyl resin A-1 (shown in TABLE 2) | 60 |
| Carbon black (Trademark "Mogul L" made by Cabot Corporation) | 25 |
| Nigrosine (made by Orient Chemical Industries, Ltd.) | 6 |
| Polypropylene (Trademark "550P" made by Sanyo Chemical Industries, Ltd.) | 12 |

The thus kneaded mixture was cooled, and roughly ground using a hammer mill, and then finely pulverized using a jet mill, and thereafter classified, so that a toner with an average particle diameter of 10 to 11 $\mu$m was prepared.

EXAMPLES 2 TO 4 AND COMPARATIVE EXAMPLES 1 TO 4

The procedure for preparation of the toner in Example 1 was repeated except that a mixture of the polyester resin I and the vinyl resin A-1 used as the binder resin in Example 1 was replaced by the respective resins shown in TABLE 3, and that the kneading conditions such as the temperature and the time were changed as shown in TABLE 3.

In examples 2 to 4 and Comparative Examples 1 to 4, when a polyester resin was employed singly as in Example 2 and 4 and Comparative Examples 1 and 2, the amount of the polyester resin was 300 parts by weight. On the other hand, when a polyester resin and a vinyl resin were used in combination, the amount ratio of the polyester resin to the vinyl resin was the same as that in Example 1.

The formulation and the properties of the polyester resins used in Examples and Comparative Examples are shown in TABLE 1.

TABLE 1

| Polyester Resin | | | I | II | III | IV | V | VI | VII |
|---|---|---|---|---|---|---|---|---|---|
| Formulation | Component A (parts by weight) | TPA | 324 | 262 | — | — | — | 397 | 262 |
| | | IPA | — | — | — | 226 | — | — | — |
| | | DMT | — | — | 312 | 264 | — | — | — |
| | | AA | — | — | 26 | — | — | — | — |
| | | FA | — | — | — | — | 298 | — | — |
| | | DSA | — | 89 | — | — | — | — | 89 |
| | | TMA | — | — | — | 64 | — | — | — |
| | Component B (parts by weight) | Glycol A | 840 | — | 522 | 176 | 1080 | — | — |
| | | Glycol B | — | — | — | — | — | 378 | 378 |
| | | Glycol C | — | 384 | — | — | — | — | — |
| | | Glycol D | — | — | — | 482 | — | 702 | 618 |
| | | EG | — | — | — | — | — | 42 | 48 |
| | | NPG | — | — | — | — | — | — | — |
| | Crosslinking agent (parts by weight) | Trimethylol-propane | 60 | 45 | 60 | 60 | — | — | — |
| | | Trimellitic anhydride | — | — | — | — | — | 100 | — |
| Physical Properties | | Tg (° C.) | 60 | 56 | 61 | 55 | 57 | 64 | 63 |
| | | Acid value | 3.0 | 1.8 | 2.5 | 2.0 | 1.5 | 20 | 4 |
| | | Degree of swelling | 15 | 10 | 18 | 20 | 0 | 15 | 10 |
| | | Water content (ppm) | 2800 | 2800 | 2900 | 2500 | 2700 | 6500 | 3000 |
| | | THF-insoluble component (%) | 25 | 15 | 40 | 30 | 0 | 30 | 25 |

In TABLE 1;

(1) Glycol A: polyoxypropylene(2,2)-2,2-bis(4-hydroxyphenyl) propane (Hydroxyl value: 315)

(2) Glycol B: polyoxyethylene(2,3)-2,2-bis(4-hydroxyphenyl) propane (Hydroxyl value: 340)

(3) Glycol C: poly(oxyethylene-propylene)-bis(4-hydroxyphenyl) propane (Hydroxyl value: 320)

(4) Glycol D: polyoxypropylene(3,1)-2,2-bis(4-hydroxyphenyl) propane (Hydroxyl value: 275)

(5) EG: ethylene glycol (6) NPG: neopentyl glycol (7) TPA: terephthalic acid (8) IPA: isophthalic acid (9) FA: fumaric acid

(10) AA: adipic acid

(11) DMT: dimethyl terephthalate

(12) DSA: dodecenyl succinic anhydride

(13) TMA: trimellitic anhydride

The formulation and the properties of the vinyl resins used in Examples 1 and 3 and Comparative Examples 3 and 4 are shown in TABLE 2.

TABLE 2

| Vinyl Resin | | A-1 | A-2 |
|---|---|---|---|
| Formulation | Styrene | 500 g | 500 g |
| | n-BMA | 200 g | 200 g |
| | Divinylbenzene | 5.0 g | 7.0 g |
| | BPO | 20 g | 20 g |
| | Deionized water | 1500 g | 1500 g |
| | Dodecylbenzenesulfonic acid | 10 g | 10 g |
| Reaction temperature | | 90° C. | 90° C. |
| Used gas for reaction | | $N_2$ | $N_2$ |
| Physical Properties | Tg (° C.) | 62 | 64 |
| | Acid value | 0 | 0 |
| | Degree of swelling | 15 | 12 |
| | Water content (ppm) | 1500 | 2000 |
| | THF-insoluble component (%) | 25 | 30 |

In the above TABLE 1 and TABLE 2, the physical properties of the polyester resin and the vinyl resin are measured by the following methods.

1. Acid Value and Hydroxyl Value

Measured in accordance with the respective procedures as specified in the Japanese Industrial Standards (JIS K0070), provided that when the sample is insoluble in a mixed solvent of diethyl ether and ethanol, dioxane or tetrahydrofuran is employed as a solvent therefor.

2. Glass Transition Temperature

Measured in accordance with the procedure (DSC method) as specified in ASTM D3418-82.

3. Measurement of the Content of THF-insoluble Component

About 50 g of THF is added to about 1 g (A) of a resin or toner sample, and the mixture is allowed to stand at 20° C. for 24 hours, and is then centrifuged and filtered through a filter paper Class C for quantitative measurement specified in the Japanese Industrial Standards (JIS P3801). The filtrate is evaporated to dryness in vacuum to obtain a residual resin component. The thus obtained resin component is weighed to measure the residual about (B) of the resin, which is the amount of a THF-soluble component.

The percentage (%) of a THF-insoluble component is calculated, using the following formula:

$$\text{THF-insoluble component } (\%)=\{(A-B)/A\}\times 100$$

In the case of the toner, the percentage (%) of the THF-insoluble component is calculated, using the following formula, provided that the amount (W1) of a THF-soluble component and the amount (W2) of the THF-insoluble component in the components other than the resin are measured in advance by a conventional method:

$$\text{THF-insoluble component } (\%)=\{(A-B-W2)/(A-W1-W2)\}\times 100$$

4. Measurement of the Degree of Swelling in THF

About 100 g of THF is added to 1 g of a resin. This mixture is allowed to stand at 10° C. for 20 to 30 hours. In 20 to 30 hours, a gel component, which is a THF-insoluble component contained in the resin, swells with the THF, and precipitates. The precipitated gel component which is caused to swell with the THF is filtered off and is then weighed. The weight of the swollen gel component is W1. The gel component is dried to evaporate the absorbed THF from the gel component at 120° C. for 3 hours. The weight of the dried gel component is W2. The weight W2 is the weight of a THF-insoluble component in the resin. The degree of swelling is calculated, using the following formula:

$$\text{Degree of swelling}=W1/W2$$

Thus, the degree of swelling is a ratio of the weight W1 of the THF-absorbed gel component to the weight W2 of the gel component free of the THF.

A. Evaluation of Toner

Each of the above toners prepared in Examples 1 to 4 and Comparative Examples 1 to 4 was evaluated in terms of the following properties.

When the properties of the toner were judged from the formation of toner images, the toner images were formed using a two-component developer prepared by the following method.

[Preparation of two-component developer]

50 parts by weight of each toner comprising toner particles with a particle diameter of 10 to 11 μm were mixed with 950 parts by weight of a silicone-resin coated carrier comprising core particles with a particle size of 100 μm and a resin layer coated on the core particles and made of a commercially available silicone resin "KR-250" (Trademark) made by Shin-Etsu Chemical Co., Ltd. The resultant mixture was completely stirred to prepare a two-component developer.

Each of the obtained two-component developers was set in a modified machine of a commercially available copying apparatus "SPIRIO 2700" (Trademark), made by Ricoh Company, Ltd., which was provided with a toner recycle system.

A-1: Crushability in Preparation of Toner

The kneaded mixture for constituting the toner was roughly grounded using a hammer mil, and then finely pulverized using a jet-type air mill.

The crushability was expressed by the amount (kg) of toner that could be introduced into the mill to produce toner particles with an average particle size of 10.0 μm. The applied air pressure was set at 5.0 kg/cm$^2$.

It is considered that the production efficiency of toner is excellent when the crushability is high.

A-2. Minimum Image Fixing Temperature

Using the modified copying apparatus free from the image fixing unit, a toner image was transferred to an image receiving sheet, but not fixed thereon. The toner-image bearing sheet was caused to pass through an image fixing unit with a heat-application roller, with the temperature of the heat-application roller being variously changed. Each time the image fixing was completed, the fixed toner image was rubbed with cotton. The minimum image fixing temperature was regarded as the lowest image fixing temperature where the cotton was not stained with toner even after rubbing.

A-3. Hot Offset Temperature

After the completion of image fixing, a fresh image receiving sheet (bearing no toner image) was caused to pass through the above-mentioned heat-application roller in order to examine the deposition of toner particles on the surface of the heat-application roller. The hot-offset temperature was regarded as the upper limit temperature of the heat-application roller where the above-mentioned fresh image receiving sheet was not stained with toner.

The higher the hot-offset temperature, the better the anti-hot-offset performance.

B. Evaluation of Recyclability of Toner

B-1: Content of Crushed Toner Particles

After making of 100,000 copies, the particle size distribution of the toner particles was obtained using a commercially available measuring apparatus, "Coulter Counter TA II" made by Coulter Electronics Ltd. In this case, a 1% aqueous solution of NaCl was used as an electrolyte, and "Drywell™" was used as a dispersant. From the data of molecular weight distribution output by a computer, the number of toner particles with a particle size of 5.04 μm or less (which were regarded as the crushed particles) was obtained, and the ratio of those crushed toner particles of the entire toner particles was calculated.

B-2: Aggregation Degree of Toner Particles

After making of 100,000 copies, toner particles were taken out of the development unit, and it was examined whether agglomerate of toner particles was present or not.

The aggregation degree of toner particles was evaluated on the following scale.

○: There was no agglomerate of toner particles.

Δ: Some agglomerates were observed, but acceptable for practical use.

X: A lot of agglomerates were observed, which was not acceptable for practical use.

B-3: Fluidity of Toner Particles

After making 100,000 copies, toner particles were taken out of the development unit, and the fluidity of toner particles was visually inspected.

The fluidity of toner particles was evaluated on the following scale.

○: Good.

Δ: Slightly poor, but acceptable for practical use.

X: Very poor, and not acceptable for practical use.

B-4. Durability of Toner

The image density of a slid image portion obtained after making of 100,000 copies was compared with the initial image density of a solid image portion. The durability of toner was evaluated on the following scale:

○: There was no decrease in image density, and a clear image was obtained after making of 100,000 copies.

Δ: A certain decrease in image density was observed, but acceptable for practical use.

X: The decrease in image density was noticeable, and not acceptable for practical use.

B-5. Toner Deposition on Background of Image

After making of 100,000 copies, the degree of toner deposition on the background of the obtained image was evaluated on a scale from 1 to 3.

1: There was no toner deposition on the background, and the obtained image was clear.

2. Slight toner deposition was observed on the background of the obtained image, but acceptable for practical use.

3. The toner deposition on the background was very noticeable, and not acceptable for practical use.

B-6. Image Quality of Toner Image

After making of 100,000 copies, the image quality of the obtained toner images was evaluated in terms of the occurrence of abnormal images, such as image blurring and adhesion of carrier particles together with toner particles to the image receiving sheets.

B-7. Environmental Stability with Respect to Charging

The toner was charged under conditions of high temperature (30° C.) and high humidity (90% RH), and also under the conditions of low temperature (10° C.) and low humidity (30% RH). When the ratio of the one of the obtained charge quantities of toner to the other charge quantity of toner was less than 30%, the environmental stability with respect to charging was considered to be acceptable; while when the ratio was 30% or more, the environmental stability was poor.

The results of those evaluations are shown in TABLE 3.

TABLE 3

| | | Ex. 1 | Ex. 2 | Ex. 3 | Ex. 4 | Comp. Ex. 1 | Comp. Ex. 2 | Comp Ex. 3 | Comp. Ex. 4 |
|---|---|---|---|---|---|---|---|---|---|
| Binder resin | Used polyester resin | I | II | III | IV | VII | VI | V | II |
| | Used vinyl resin | A-1 | — | A-2 | — | — | — | A-2 | A-2 |
| Kneading Conditions | Temp. (° C.) | 130 | 140 | 145 | 140 | 130 | 130 | 160 | 180 |
| | Time (min.) | 30 | 30 | 20 | 40 | 60 | 20 | 20 | 20 |
| Characteristics of Toner Obtained after Kneading | Mw at top peak | 6500 | 7000 | 6000 | 8500 | 4000 | 5500 | 6000 | 8700 |
| | Percent of THF-soluble component with Mw of 10,000 or less | 50 | 41 | 55 | 53 | 44 | 68 | 50 | 30 |
| | Sub-peak of Mw distribution | present | present | present | present | present | present | absent | present |
| | Ts (° C.) | 76 | 74 | 78 | 73 | 74 | 75 | 75 | 78 |
| | Tfb (° C.) | 120 | 115 | 120 | 121 | 127 | 135 | 110 | 140 |
| | T1/2 (° C.) | 150 | 145 | 153 | 145 | 151 | 160 | 140 | 170 |
| | Tend (° C.) | 160 | 155 | 170 | 155 | 161 | 185 | 147 | 200 |
| | Formulae (1) and (2) by flow tester | satisfied | satisfied | satisfied | satisfied | satisfied | not satisfied | not satisfied | not satisfied |
| | Water content (ppm) | 2600 | 3500 | 2100 | 3500 | 6200 | 5500 | 4500 | 6000 |
| Evaluation of Toner | Crushability (kg) | 20 | 22 | 23 | 18 | 25 | 25 | 17 | 10 |
| | Minimum image fixing Temp. (° C.) | 135 | 135 | 130 | 140 | 135 | 150 | 130 | 160 |
| | Hot offset Temp. (° C.) | ≧240 | ≧240 | ≧240 | ≧240 | ≧240 | ≧240 | 200 | ≧240 |
| Recyclability of Toner | Content of crushed toner particles (%) | 18 | 16 | 24 | 15 | 38 | 20 | 32 | 16 |
| | Aggregation degree | ○ | ○ | ○ | ○ | X | ○ | X | ○ |
| | Fluidity | ○ | ○ | ○ | ○ | X | ○ | X | ○ |
| | Durability | ○ | ○ | ○ | ○ | X | ○ | X | ○ |
| | Toner deposition on background | 1 | 1 | 2 | 1 | 3 | 1 | 3 | 2 |
| | Image quality | ○ | ○ | ○ | ○ | adhesion of carrier | ○ | black spots | ○ |
| | Environmental stability at charging step | ○ | ○ | ○ | ○ | X | X | ○ | X |

In TABLE 3, as can be seen from the results shown in Comparative Example 1, the top peak in the molecular weight distribution of the tetrahydrofuran-soluble component of toner is as low as 4,000. Therefore, the amount of crushed toner particles is increased in the copying apparatus, thereby lowering the properties concerning the recyclability of toner.

In Comparative Examples 1, 2 and 4, the water content of toner is more than 5,000 ppm, so that the environmental stability is poor. Further, the conditions represented by the formulae (1) and (2), which are obtained by the measurement using a flow tester, are not satisfied in Comparative Examples 2, 3 and 4. As a result, the image fixing performance and anti-hot-offset performance are unsatisfactory.

In Comparative Example 3, there is no sub-peak in the weight-average molecular weight distribution of the toner. The result is that the amount of crushed toner particles is increased, thereby lowering the properties concerning the recyclability of toner. In addition, the hot offset occurs at a relatively low temperature.

In Comparative Example 4, the temperatures obtained by the measurement with the flow tester are relatively high, so that the image fixing performance is poor.

In contrast to the above, occurrence of crushed toner particles in the apparatus can be effectively prevented in Examples 1 to 4, so that there is no problem in image quality of the obtained toner image. The environmental stability, image fixing performance, and anti-hot-offset performance of toner are improved in the recycling of the toner.

EXAMPLES 5 TO 8 AND COMPARATIVE EXAMPLES 5 AND 6

The procedure for preparation of the toner in Example 1 was repeated except that a mixture of the polyester resin I and the vinyl resin A-1 used as the binder resin in Example 1 was replaced by the respective polyester resins shown in TABLE 4, and that the kneading conditions such as the temperature and the time were changed as shown in TABLE 3.

Each of the toners prepared in Examples 5 to 8 and Comparative Examples 5 and 6 was evaluated in the same manner as mentioned above.

The results of the characteristics and the recyclability of each toner are shown in TABLE 4.

TABLE 4

| | | Ex. 5 | Ex. 6 | Ex. 7 | Ex. 8 | Comp. Ex. 5 | Comp. Ex. 6 |
|---|---|---|---|---|---|---|---|
| Binder resin | Used polyester resin | I | II | III | IV | VII | VI |
| | Used vinyl resin | — | — | — | — | — | — |
| Kneading Conditions | Temp. (° C.) | 130 | 140 | 145 | 140 | 130 | 170 |
| | Time (min.) | 60 | 60 | 45 | 60 | 60 | 60 |
| Characteristics of Toner Obtained after Kneading | Mw at top peak | 6500 | 8500 | 5600 | 8200 | 3500 | 6800 |
| | Percent of THF-soluble component with MW of 10,000 or less | 50 | 40 | 42 | 39 | 63 | 65 |
| | Sub-peak of Mw distribution | present | present | present | present | present | present |
| | Ts (° C.) | 74 | 78 | 78 | 73 | 74 | 80 |
| | Tfb (° C.) | 118 | 125 | 125 | 121 | 121 | 135 |
| | T1/2 (° C.) | 150 | 155 | 155 | 145 | 151 | 160 |
| | Tend (° C.) | 158 | 162 | 168 | 160 | 161 | 185 |
| | Formulae (1) and (2) by flow tester | satisfied | satisfied | satisfied | satisfied | satisfied | not satisfied |
| | Water content (ppm) | 4200 | 3900 | 4100 | 4700 | 6500 | 5900 |
| Evaluation of Toner | Crushability (kg) | 20 | 22 | 23 | 25 | 25 | 20 |
| | Minimum image fixing Temp (° C.) | 135 | 135 | 135 | 130 | 135 | 150 |
| | Hot offset Temp. (° C.) | ≧240 | ≧240 | ≧240 | ≧240 | ≧240 | ≧240 |
| Recyclability of Toner | Content of crushed toner particles (%) | 18 | 14 | 16 | 17 | 39 | 17 |
| | Aggregation degree | ○ | ○ | ○ | ○ | X | ○ |
| | Fluidity | ○ | ○ | ○ | ○ | X | Δ |
| | Durability | ○ | ○ | ○ | ○ | X | X |
| | Toner deposition on background | 1 | 1 | 1 | 1 | 3 | 2 |
| | Image quality | ○ | ○ | ○ | ○ | black spots | ○ |
| | Environmental stability at charging step | ○ | ○ | ○ | ○ | X | X |

In TABLE 4, the molecular weight of the toner is as low as 3500 at the top peak in the molecular weight distribution in Comparative Example 5, so that the amount of crushed toner particles is increased, thereby lowering the image quality of the obtained toner image.

In Comparative Example 6, the conditions represented by the formulae (1) and (2), which are obtained by the measurement using the flow tester, are not satisfied. Therefore, the image fixing performance is lowered.

In contrast to the above, the environmental stability of any toners obtained in Examples 5 to 8 is excellent, and clear toner images can be produced. This is because the number of crushed toner particles is not increased in the toner recycle system, and the water content of toner is 5000 ppm or less.

REFERENCE EXAMPLE 1

A toner was prepared in the same manner as in Example 1.

The above-mentioned toner was mixed with a silicone-resin coated magnetite carrier, and a non-coated magnetite carrier, so that two kinds of the two-component developers were obtained.

Each of the above-mentioned two-component developers was set in a commercially available copying apparatus (Trademark "SPIRIO 4000", made by Ricoh Company, Ltd.) provided with a toner recycle system, and 100,000 copies were made for evaluation.

As a result, the characteristics and the recyclability of the toner were similar to those obtained in Example 1 when the silicone-resin coated magnetite carrier was employed. On the other hand, when the non-coated magnetite carrier was employed together with the toner, the charging stability of toner was considerably lowered, so that the image density of the obtained toner image was unstable.

REFERENCE EXAMPLE 2

A toner was prepared in the same manner as in Example 2.

The above-mentioned toner was mixed with a silicone-resin coated magnetite carrier, and a non-coated magnetite carrier, so that two kinds of the two-component developers were obtained.

Each of the above-mentioned two-component developers was set in a commercially available copying apparatus (Trademark "SPIRIO 4000", made by Ricoh Company, Ltd.) provided with a toner recycle system, and 100,000 copies were made for evaluation.

As a result, the characteristics and the recyclability of the toner were similar to those obtained in Example 2 when the silicone-resin coated magnetite carrier was employed. On the other hand, when the non-coated magnetite carrier was employed together with the toner, the charging stability of toner was considerably lowered, so that the image density of the obtained toner image was unstable.

Japanese Patent Applications Nos. 10-283965 filed Oct. 6, 1988, 10-334063 filed Nov. 25, 1998, and 11-256901 filed Sep. 10, 1999 are hereby incorporated by reference.

What is claimed is:

1. A toner for developing a latent electrostatic image to a visible toner image used in an image formation method in which a toner recycle system is adopted, wherein said toner is such a toner that a tetrahydrofuran-soluble component contained therein exhibits a sub-peak within a weight-average molecular weight range of 100,000 to 10,000,000 in a molecular weight distribution measured by gel permeation chromatography, and said toner has a water content of 5000 ppm or less when said toner has been allowed to stand at 30° C., 60% RH for 24 hours.

2. The toner as claimed in claim 1, wherein said tetrahydrofuran-soluble component exhibits a top peak in a weight-average molecular weight range of 5,000 to 10,000 in said molecular weight distribution, and 35% to 55% of said tetrahydrofuran-soluble component has a weight-average molecular weight of 10,000 or less, and said toner satisfies the conditions represented by formulae (1) and (2), as measured by a flow tester of capillary type:

$$2\times Tfb-Tend-Ts\leqq 15 \quad (1)$$

$$15\leqq Tend-Ts-2\times(T\tfrac{1}{2}-Tfb)\leqq 40 \quad (2)$$

wherein Ts represents a softening point of said toner, Tfb represents a flow beginning temperature of said toner, Tend represents a flow ending temperature of said toner, and T½ represents a fusing temperature of said toner in T½ method.

3. The toner as claimed in claim 1, further comprising a binder resin which comprises a polyester resin.

4. The toner as claimed in claim 2, further comprising a binder resin which comprises a polyester resin.

5. A toner for developing a latent electrostatic image to a visible toner image used in an image formation method in which a toner recycle system is adopted, wherein said toner is such a toner that a tetrahydrofuran-soluble component contained therein exhibits a sub-peak within a weight-average molecular weight range of 100,000 to 10,000,000 in a molecular weight distribution measured by gel permeation chromatography, and said toner has a water content of 5000 ppm or less when said toner has been allowed to stand at 30° C., 60% RH for 24 hours, said toner being prepared by fusing and kneading:

a binder resin comprising a tetrahydrofuran-insoluble component in an amount of 5 to 40 wt. %, said tetrahydrofuran-insoluble component having a degree of swelling in tetrahydrofuran in a range of 2 to 20, a coloring agent, a charge control agent, and optionally other additive and optionally a releasing agent.

6. The toner as claimed in claim 5, wherein said tetrahydrofuran-soluble component exhibits a top peak in a weight-average molecular weight range of 5,000 to 10,000 in said molecular weight distribution, and 35 to 55% of said tetrahydrofuran-soluble component has a weight-average molecular weight of 10,000 or less, and said toner satisfies the conditions represented by formulae (1) and (2), as measured by a flow tester of capillary type:

$$2\times Tfb-Tend-Ts\leqq 15 \quad (1)$$

$$15\leqq Tend-Ts-2\times(T\tfrac{1}{2}-Tfb)\leqq 40 \quad (2)$$

wherein Ts represents a softening point of said toner, Tfb represents a flow beginning temperature of said toner, Tend represents a flow ending temperature of said toner, and T½ represents a fusing temperature of said toner in T½ method.

7. The toner as claimed in claim 5, wherein said binder resin comprises a polyester resin.

8. The toner as claimed in claim 6, wherein said binder resin comprises a polyester resin.

9. An image formation method in which a toner recycle system is adopted, using a toner for developing a latent electrostatic image to a visible toner image, wherein said toner is such a toner that a tetrahydrofuran-soluble component contained therein exhibits a sub-peak within a weight-average molecular weight range of 100,000 to 10,000,000 in a molecular weight distribution measured by gel permeation chromatography, and said toner has a water content of 5000 ppm or less when said toner has been allowed to stand at 30° C., 60% RH for 24 hours.

10. The image formation method as claimed in claim 9, wherein said tetrahydrofuran-soluble component in said toner exhibits a top peak in a weight-average molecular weight range of 5,000 to 10,000 in said molecular weight distribution, and 35% to 55% of said tetrahydrofuran-soluble component has a weight-average molecular weight of 10,000 or less, and said toner satisfies the conditions represented by formulae (1) and (2), as measured by a flow tester of capillary type:

$$2\times Tfb-Tend-Ts\leqq 15 \quad (1)$$

$$15\leqq Tend-Ts-2\times(T\tfrac{1}{2}-Tfb)\leqq 40 \quad (2)$$

wherein Ts represents a softening point of said toner, Tfb represents a flow beginning temperature of said toner, Tend represents a flow ending temperature of said toner, and T½ represents a fusing temperature of said toner in T½ method.

11. The image formation method as claimed in claim 9, wherein said toner further comprises a binder resin comprising a polyester resin.

12. The image formation method as claimed in claim 10, wherein said toner further comprises a binder resin comprising a polyester resin.

13. An image formation method in which a toner recycle system is adopted, using a toner for developing a latent electrostatic image to a visible toner image, wherein said toner is such a toner that a tetrahydrofuran-soluble component contained therein exhibits a sub-peak within a weight-average molecular weight range of 100,000 to 10,000,000 in a molecular weight distribution measured by gel permeation chromatography, and said toner has a water content of 5000 ppm or less when said toner has been allowed to stand at 30° C., 60% RH for 24 hours, said toner being prepared by fusing and kneading:

a binder resin comprising a tetrahydrofuran-insoluble component in an amount of 5 to 40 wt. %, said tetrahydrofuran-insoluble component having a degree of swelling in tetrahydrofuran in a range of 2 to 20, a coloring agent, a charge control agent, and optionally other additive and optionally a releasing agent.

14. The image formation method as claimed in claim 13, wherein said tetrahydrofuran-soluble component exhibits a top peak in a weight-average molecular weight range of 5,000 to 10,000 in said molecular weight distribution, and 35% to 55% of said tetrahydrofuran-soluble component has a weight-average molecular weight of 10,000 or less, and said toner satisfies the conditions represented by formulae (1) and (2), as measured by a flow tester of capillary type:

$$2\times Tfb-Tend-Ts\leqq 15 \quad (1)$$

$$15\leqq Tend-Ts-2\times(T½-Tfb)\leqq 40 \quad (2)$$

wherein Ts represents a softening point of said toner, Tfb represents a flow beginning temperature of said toner, Tend represents a flow ending temperature of said toner, and T½ represents a fusing temperature of said toner in T½ method.

15. The image formation method as claimed in claim 13, wherein said binder resin comprises a polyester resin.

16. The image formation method as claimed in claim 14, wherein said binder resin comprises a polyester resin.

* * * * *